US006523982B1

(12) United States Patent
Haddad

(10) Patent No.: US 6,523,982 B1
(45) Date of Patent: Feb. 25, 2003

(54) TOOL-LESS ENTRY LANDSCAPE FIXTURE

(75) Inventor: Eric O. M. Haddad, East Berlin, PA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/811,242

(22) Filed: Mar. 16, 2001

(51) Int. Cl.[7] ..... F21V 17/00

(52) U.S. Cl. ..... 362/375; 362/267; 362/431; 362/351

(58) Field of Search ..... 362/374, 375, 362/267, 431, 297, 396, 351

(56) References Cited

U.S. PATENT DOCUMENTS

| | | | | |
|---|---|---|---|---|
| 1,204,801 A | * | 11/1916 | McArthur | 362/159 |
| 1,247,000 A | | 11/1917 | Plaut | |
| 1,701,176 A | | 2/1929 | Doane | |
| 2,198,077 A | | 4/1940 | Curtis | |
| 3,055,535 A | * | 9/1962 | Schneider | 362/365 |
| 3,748,465 A | | 7/1973 | Murray et al. | |
| 4,410,931 A | * | 10/1983 | DeCandia et al. | 362/267 |
| 4,471,411 A | | 9/1984 | Graham et al. | |
| 4,516,196 A | | 6/1985 | Blake | |
| 4,587,602 A | | 6/1986 | Dean et al. | |
| 4,633,377 A | | 12/1986 | Mackiewicz | |
| 4,851,970 A | | 7/1989 | Bronder | |
| 5,278,745 A | | 1/1994 | Kelly et al. | |
| 5,289,358 A | | 2/1994 | Halemeier | |
| 5,615,947 A | | 4/1997 | Shambo et al. | |
| 5,997,158 A | | 12/1999 | Fischer et al. | |
| 6,059,422 A | | 6/2000 | Fischer et al. | |

* cited by examiner

*Primary Examiner*—Sandra O'Shea
*Assistant Examiner*—Ali Alavi

(57) ABSTRACT

A tool-less entry landscape fixture having a base structure, a fixture cover hingeably attached to the base structure, a flexible closing mechanism depending from said fixture cover, and a structure for retaining said flexible closing mechanism. Electrical components of the light fixture are sealed by sealing gaskets, preferably of silicone, located on an upper and lower circumference of the optical lens. The tool-less entry landscape fixture's flexible closing mechanism is operable by hand so that tools are not required for routine maintenance such as changing of a bulb. Moreover the tool-less entry landscape fixture has no small parts which require removal during routine maintenance.

24 Claims, 6 Drawing Sheets

TOOL-LESS ENTRY LANDSCAPE FIXTURE

BACKGROUND OF THE INVENTION

1. Technical Field of the Invention

The present invention relates to a tool-less entry landscape fixture. More particularly, a landscape fixture having a plurality of arms hingeably connected to a fixture cover, requiring no tools to open the fixture cover and having no small parts which require removal during ordinary maintenance of the landscape fixture.

2. Description of the Related Art

There are various types of landscape fixtures for use in illuminating a garden, walkway, driveway, or yard. From time to time these fixtures require some type of maintenance to be performed, such as changing a light bulb. Although, many of these landscape fixtures have various means of accessing the internal electric components in order to perform the required maintenance, many of these various means require the use of tools to access the internal structures of the fixture. In addition, many of these fixtures have small removable parts which could easily be dropped or otherwise misplaced during ordinary maintenance of the fixture.

For example, one fixture described in U.S. Pat. No. 6,059,422 to Fischer, et al. has a hinged access but requires a separate tool for opening and closing the fixture in order to access the bulb. Moreover, the fixture requires the additional use of the described tool for removing and replacing a light bulb.

Another fixture such as the one shown in U.S. Pat. No. 4,587,602 to Dean et al. teaches an outdoor light housing having a hingeably attached door. The access door is held in a closed position by a bolt, thus necessitating the use of a tool to open and close the fixture. Moreover the bolt could be lost when it is removed from the fixture during routine maintenance.

Herein, lies the problem with various lighting fixtures currently available. Many of these fixtures require the use of tools to access the internal structure of the fixture and maintain the light. This adds to the cost of maintaining the fixture because a plurality of maintenance tools have to be purchased. In addition many of the these fixtures have small parts which can easily be lost if placed on the ground during maintenance. For instance, if a person loses the door bolt of the lamp described in the Dean, et al. patent then the lighting fixture would be unsafe as water could enter the internal area of the structure housing electrical components.

SUMMARY OF THE INVENTION

It is therefore an object of the present invention to provide landscape fixture having tool-less access to the internal fixture structure.

It is a further objective of this invention to provide a landscape fixture having no small parts which require removal during ordinary maintenance, and which otherwise could be lost during maintenance of the landscape fixture.

It is still a further objective of the invention to provide a landscape fixture having a flexible latch for connecting a fixture cover to the landscape fixture.

It is still a further objective to have a long life light bulb sealed from weather elements within the tool-less entry light fixture.

It is an additional object of the present invention to provide a tool-less entry landscape fixture which provides an adequate seal of the bulb an other electrical components without the need of closing and retaining mechanisms which require tools to remove or loosen. Particularly, a tool-less fixture which securely seals with merely a manually releasable retaining mechanism is desired.

One embodiment of a tool-less entry landscape fixture has a base structure having an upper and a lower portion, a fixture cover hingeably connected to the base structure, and a flexible closing mechanism retaining the fixture cover to the upper portion of the base structure. The tool-less entry landscape fixture further comprises first and second hinges extending from first and second radially extending arms which are fixably attached to the base structure. The upper portion of the tool-less entry landscape fixture may be substantially conical in shape and has a shelf for placing a lens and the lower portion of the base structure is substantially cylindrical in shape, hollow, and may be partially threaded. The substantially bowl shaped fixture cover has a reflective coating on one side and has first and second hinge connection members depending therefrom and hingeably connected to the first and second hinges by means of first and second pins. The tool-less entry landscape fixture of the present invention may be substantially mushroom shaped and further comprises an optical lens which is cylindrical in shape having sealing gaskets made of silicone around an upper circumference and a lower circumference for sealing between the fixture cover and the upper portion of the base structure. The tool-less entry landscape fixture further comprises a light source of the halogen type housed beneath said fixture cover.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
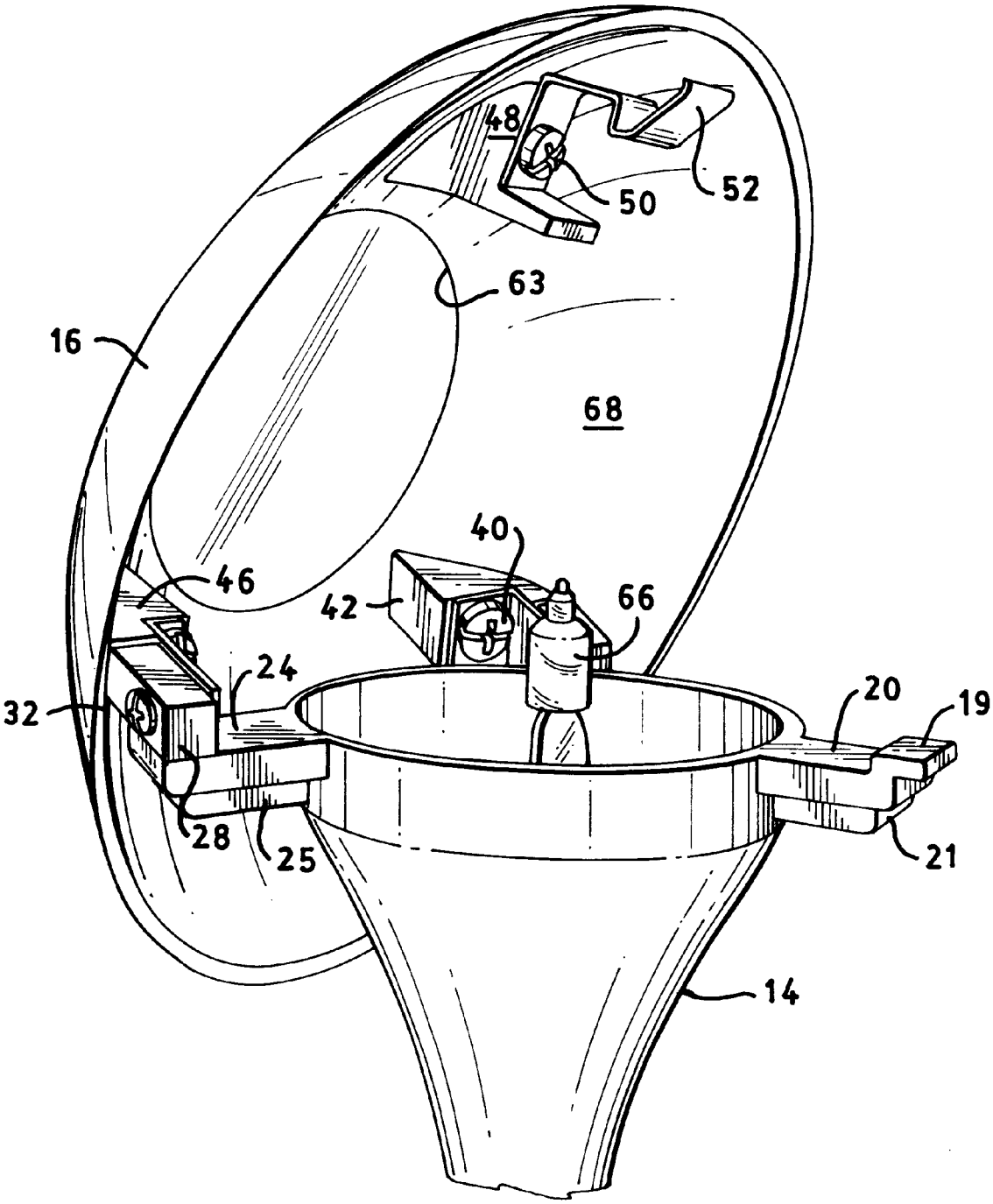
FIG. 1 is a perspective view of the tool-less entry landscape fixture of the present invention in the open position.
Figure 2:
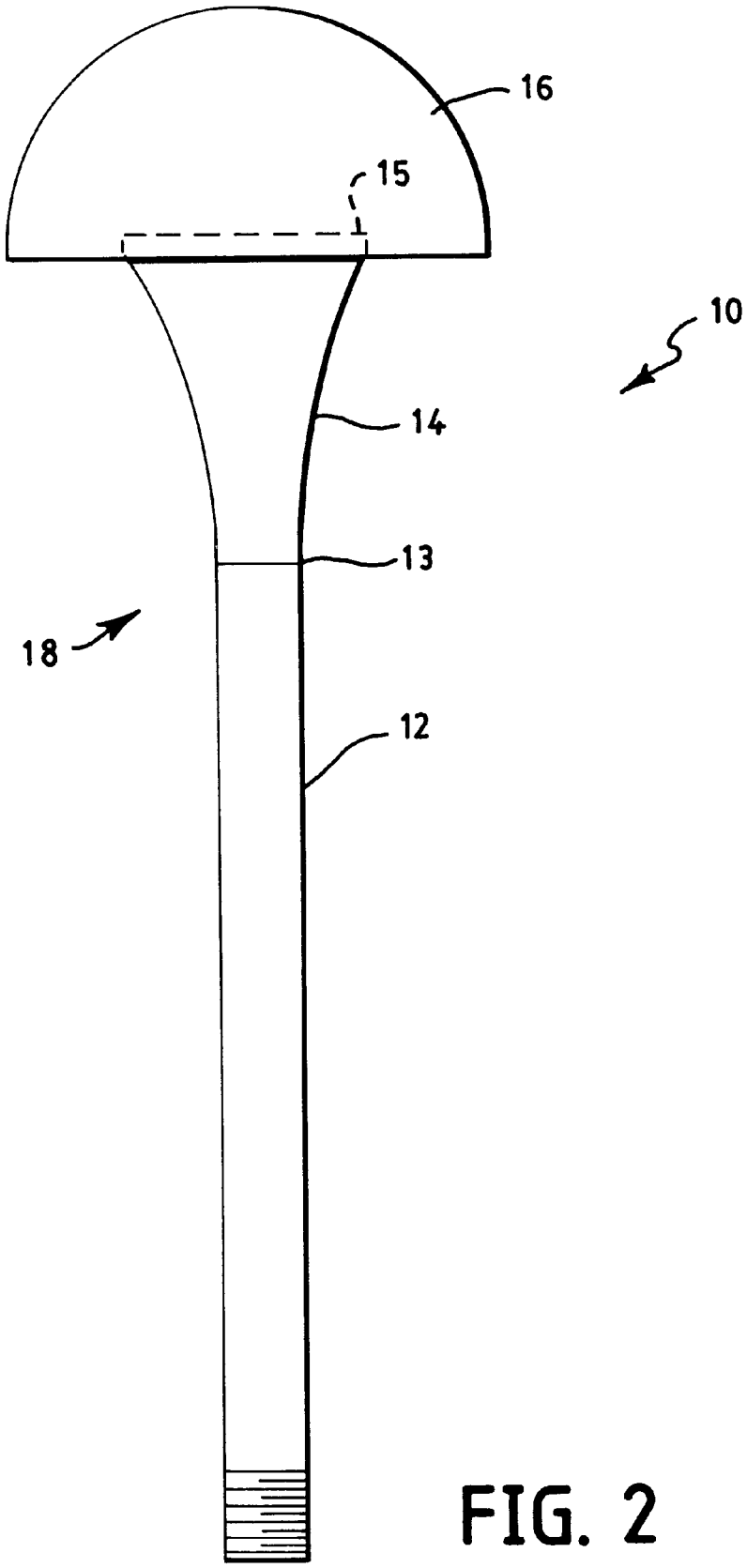
FIG. 2 is a side view of the tool-less entry landscape fixture shown in FIG. 1.
Figure 6:
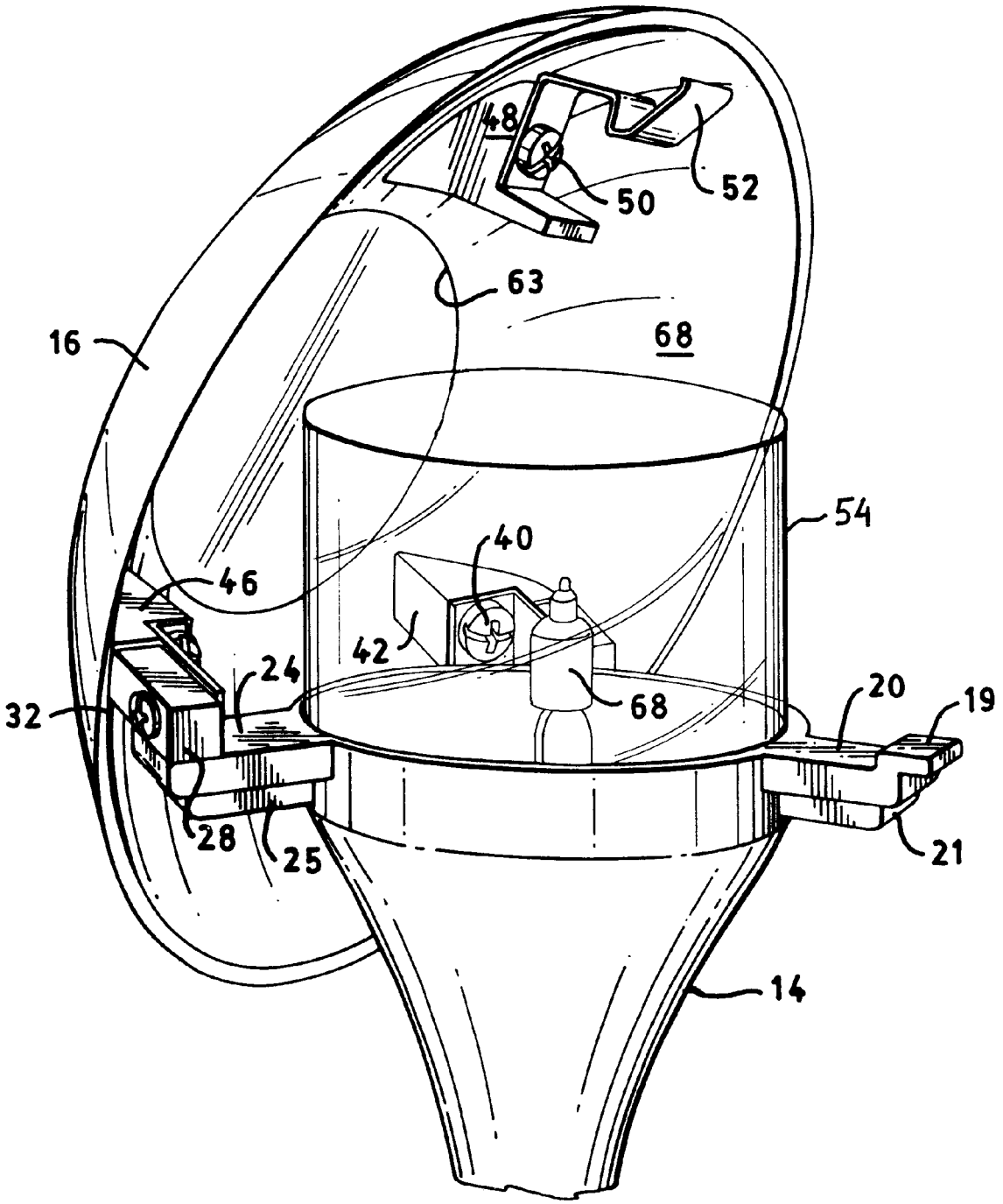

Referring initially to FIG. 1, a perspective view of one embodiment of the tool-less entry landscape fixture of the present invention in the open position. FIG. 6 shows a perspective view of one embodiment of the toolless entry landscape fixture 10 with the lens 54 in its seated position. FIG. 2 shows side view of a tool-less entry landscape fixture 10 having an exemplary height of about 20 inches in this embodiment. However, various heights may be utilized depending on the required environment. The toolless landscape entry fixture 10 is substantially mushroom shaped and has a base structure 18 comprising an upper portion 14 and a lower portion 12. The lower portion 12 of the base structure 18 is cylindrical in shape and may have an outer diameter of about one-half inch. However, one skilled in the art will recognize that the size and shape of the upper and lower portion may vary.

The lower portion 12 of the base structure 18 is made of a decorative yet weather resistant material, for protection from rain, snow, sleet, wind, ice and the like. Preferably the lower portion 12 is made of die cast aluminum or die cast brass, however various other materials may be used. Within the lower portion 12 of the base structure 18 is housed a wire (not shown) for electrical communication with the light fixture 10. The lower portion 12 affords the wire protection from the weather elements.

FIG. 2 also shows the upper portion 14 of the base structure 18. The upper portion 14 is substantially conical in shape with an upper diameter 15 and a lower diameter 13. The lower diameter 13 is nearly equivalent to the diameter of the lower portion 12. Thus, the lower portion 12 and the upper portion 14 are press fit together, or held together in some other fashion known to one skilled in the art, but still maintain an aesthetically pleasing appearance. The upper portion 14 of the base structure 18 is preferably made of die cast brass or die cast aluminum, however it can be of some other weather resistant yet decorative material. The upper portion 14 provides protection from the weather elements for various electrical components which will be discussed below.

Referring now to FIGS. 1 and 2, hingeably attached to the upper portion 14 is a fixture cover 16 which is substantially bowl-like in shape. The fixture cover 16 is made of a weather resistant material, preferably die cast aluminum or die cast brass, however various materials could be substituted. The diameter of the fixture cover 16 is around five inches, however one of skill in the art will recognize this size and shape may vary.

Figure 3:
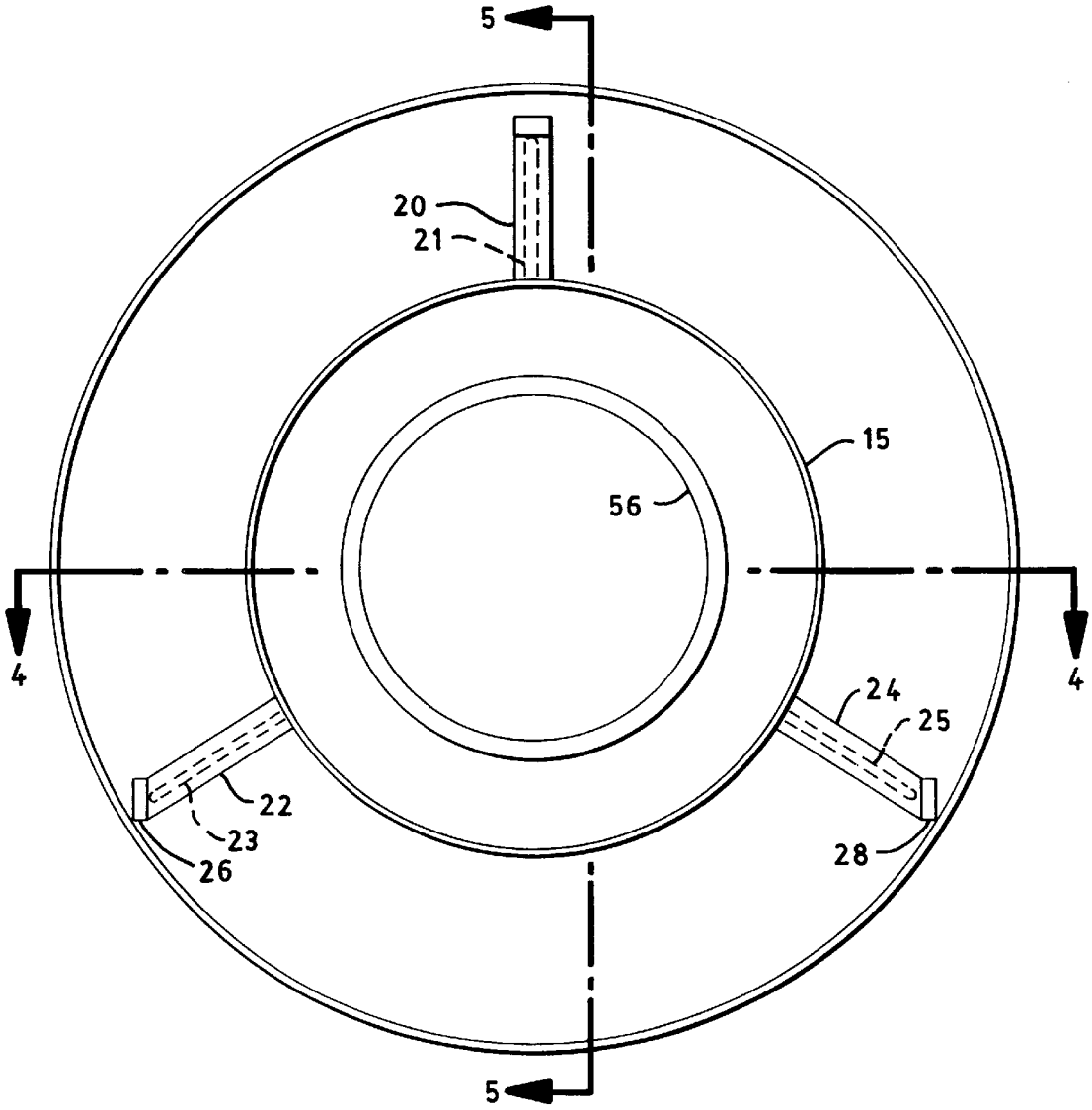
FIG. 3 is top view of the upper portion of the tool-less entry landscape fixture of FIG. 1.
Figure 4:
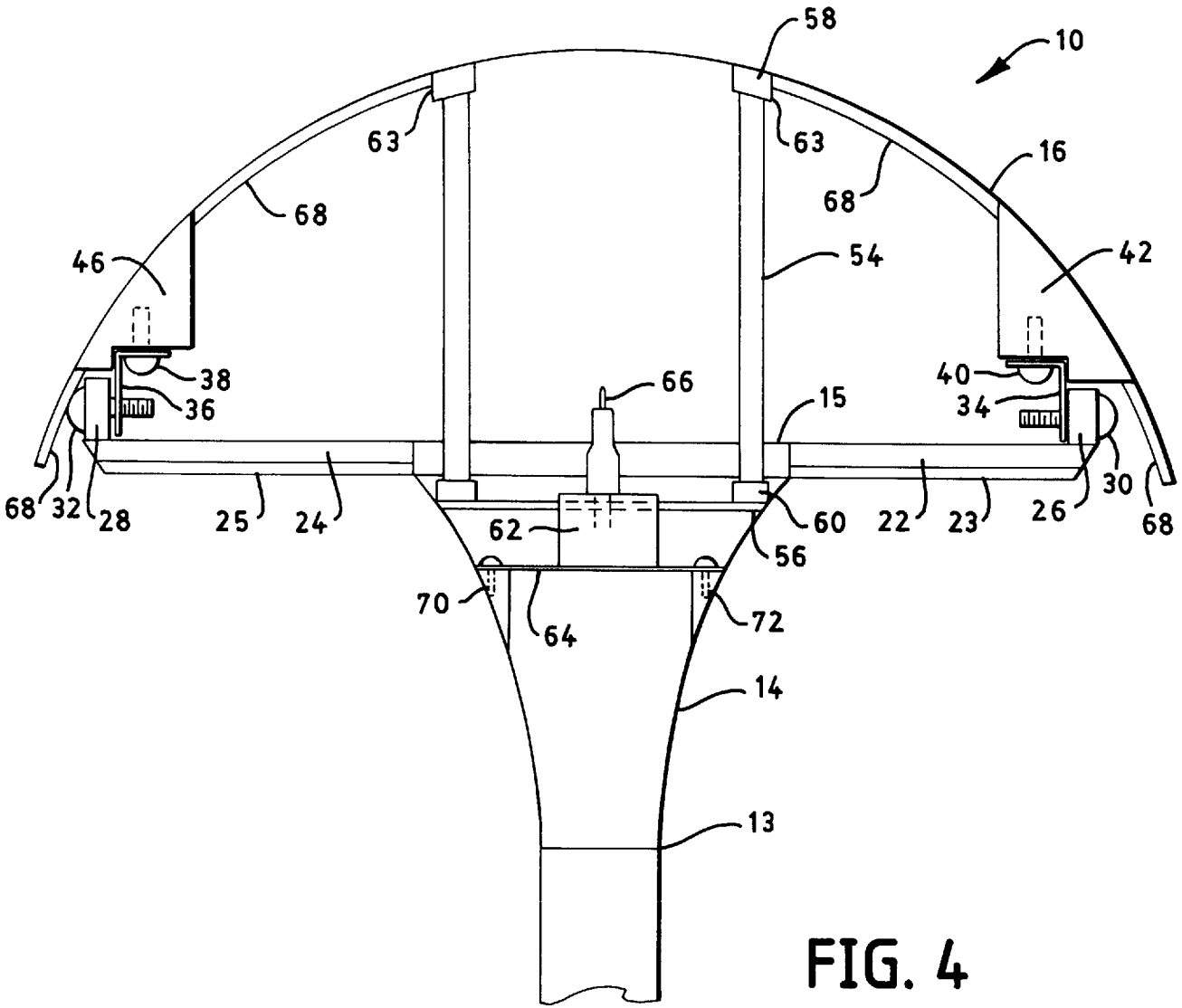
FIG. 4 is a section view of the upper portion of the tool-less entry landscape fixture of FIG. 1.

Referring now to FIGS. 3 and 4, a top view of the upper portion 14 is shown as well as a cross-section of the upper portion 14. First and second arms 22, 24 are radially extending from the perimeter of the upper diameter 15 of the upper portion 14. The arms 22, 24 are spaced about 120 degrees apart. A third arm 20 radially extends from the upper portion 14 and is spaced about 120 degrees from first and second arms 22, 24. Beneath each arm 20, 22, 24 are strengthening ribs 21, 23, 25 respectively, extending from the upper diameter 15 of the upper portion 14. Arms 22 and 24 have upwardly extending and partially rotated hinges 26, 28 located at their respective ends. Hinges 26, 28 each have a hole located therein for receiving pins 30, 32. Hinges 26, 28 are partially rotated about a vertical axis so that the brackets 34, 36 shown in FIG. 4 are properly aligned with hinge connection members 42, 46 depending from the fixture cover 16. Each pin 30, 32 acts as a hingepin which brackets 34, 36 rotate about. Pins 30, 32 are preferably #8 screws. However one skilled in the art will recognize that various sizes and types of arms, pins or hinge mechanisms can be used and that these pins need not be removed for routine maintenance. The brackets 34, 36 are also connected via screws 38, 40 to hinge connection members 42, 46 depending from an inner side of the fixture cover 16. This design allows the fixture cover 16 to hinge about pins 30, 32.

Formed within the upper portion 14 is a shelf 56 for placing a lens 54 as depicted in FIGS. 4 and 6. The lens 54 is cylindrical in shape and hollowed in the center. The lens 54 is formed of glass or some other refractive material having a thickness of about 3/16" and a diameter of about one and one-half inches (1.5"). Bonded around an upper and lower circumference of the lens 54 are upper and lower lens gaskets 58 and 60. The upper and lower lens gaskets 58 and 60 are made of a rubbery-like substance, preferably silicone, which is soft, forms to surfaces with which it comes into contact, and is impervious to water. The lower lens gasket 60 seals against the shelf 56 when the lens is properly seated in the upper portion 14. Moreover, when the fixture cover 16 is closed, the upper lens gasket 58 is seated in a lip 63, which is formed by the fixture cover 16 and the reflective coating 68. This design effectively seals electrical components housed within the upper portion 14 from weather elements such as rain, snow, sleet, ice, and the like.

Also shown housed within the upper portion 14 are various electrical components. A bulb socket 62 is housed within the upper portion 14. The bulb socket 62 is connected to a socket bracket 64 which is fixedly attached to the upper portion 14 by two screws 70, 72. However, one skilled in the art will recognize that various other means may be used to attach the socket bracket 64 to the upper portion 14. The bulb socket 62 is electrically connected with the wire (not shown) which is housed within the lower portion 12 of the base structure 18. The bulb socket 62 is further electrically connected with bulb 66. The bulb 66 is preferably a long life halogen bulb, however various types of bulbs could be used in substitution. The bulb 66 can preferably be pushed into and pulled out of the bulb socket 62 for ease of maintenance.

Figure 5:
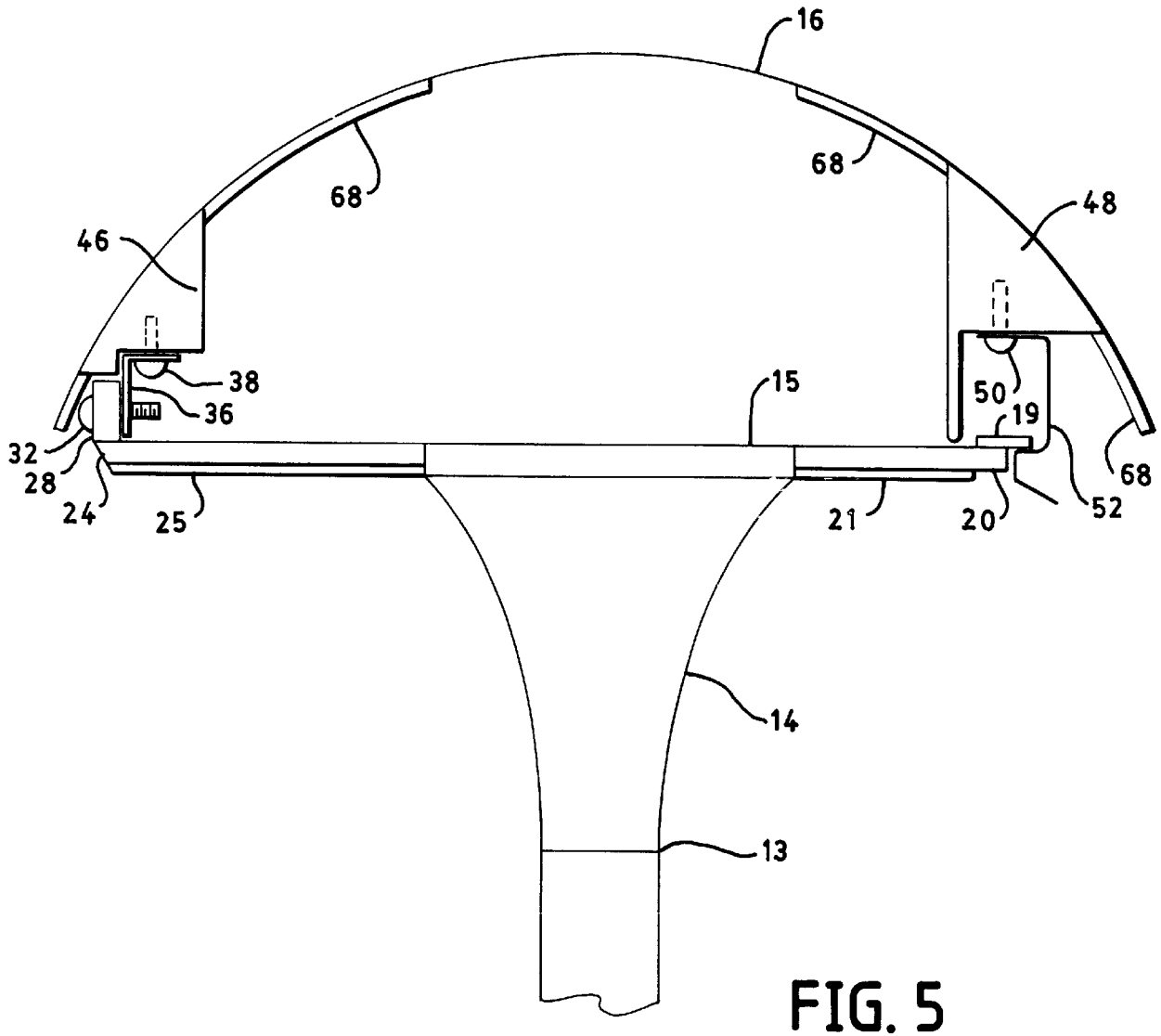
FIG. 5 is a section view of the upper portion of the tool-less entry landscape fixture of FIG. 1, which shows the closing mechanism; and, FIG. 6 is a perspective view of the tool-less entry landscape fixture of the present invention showing the lens in its properly seated position.

As shown in FIG. 5, a different side section view shows another view of the upper portion 14, and more specifically a closing mechanism 52. Arm 20 is used to closably retain the fixture cover 16 over the upper portion 14 of the base structure 18. A support bracket member 48 depends from an inner side of fixture cover 16. Screw 50 connects the closing mechanism 52, preferably a flexible latch, to the support bracket member 48. When the fixture cover 16 is moved to a closed position closing mechanism 52 holds the fixture cover 16 closed by latching over a ledge 19. To open the fixture cover 16, a maintenance person bends the latch away from ledge 19, thus providing the clearance necessary to open the fixture cover 16. In this embodiment the closing mechanism 52 can be opened and closed easily by hand and thus no tools are necessary to access the inner area of the upper portion 14. This characteristic requires that the closing mechanism 52 flex easily but not become permanently deformed. Therefore, the closing mechanism 52 is preferably made from a thin piece of metal or plastic having a thickness allowing the mechanism 52 to extend over a ledge 19 yet firmly retain the fixture cover 16 in the closed position. However, one skilled in the art knows that various other means may be utilized to connect the hinge cover and the base.

To use the tool-less entry landscape fixture 10, the base structure 18 is partially buried in the ground via landscape mounting stake, junction box or a concrete pad. To facilitate this installation, the lower portion 12 of the base structure 18 may be partially threaded for removably attaching via landscape mounting stake, junction box, concrete pad or the like. As well, the wire which is connected to bulb socket 62 for providing power, must be connected to a voltage source, preferably low voltage on the order of around 12 volts. A pool of light emitted from the tool-less entry landscape fixture 10 can be adjusted by varying the installation depth of the fixture 10 into the ground or concrete pad. For instance, if the base structure 18 of the light fixture 10 is buried deeper, the pool of light will be smaller and appear brighter. However, if the base structure 18 has a more shallow depth, the pool of light will be larger and appear dimmer.

In order to change a bulb, as part of routine maintenance, a person should turn the power source off. The closing mechanism 52 may be released from its closed position by releasing it from ledge 19. The fixture cover 16 may also be hingeably rotated to its open position, which allows access to the interior of the upper portion 14. Lens 54 is removed and the old bulb replaced with a new bulb by pulling the old bulb from the bulb socket 62 and pushing a new bulb into the bulb socket 62. Finally, the lens 54 is replaced, fixture cover 16 is rotated to a closed position, and the closing mechanism 52 is fastened over ledge 19.

The present invention provides a tool-less entry landscape fixture having a base structure 18 with an upper portion 14 and a lower portion 12. The upper portion 14 of the base structure 18 has a plurality of radial extending arms 20, 22, 24. At least one of the radially extending arms is hingeably connected to a fixture cover 16. These arms may alternatively be replaced with a continuous or semi-continuous shelf, (not shown) if required. One of ordinary skill in the art may modify the arm and hinge mechanism appropriately depending on the eventual usage and other requirements. Thus, the use of arms 20,22,24 in the shown embodiment is not considered limiting and various support structures may be readily used therefore. The fixture cover 16 can be sealingly closed against a lens 54 housed between the fixture cover 16 and the upper portion 14 of the base structure 18.

The invention may be embodied in various forms without departing from its spirit and essential characteristics. The described embodiments are not to be considered as restrictive.

I claim:

1. A tool-less entry landscape fixture comprising:

a base structure having an upper and a lower portion;

a fixture cover hingeably connected to said base structure;

a flexible closing mechanism depending from said fixture cover;

a structure to retain said flexible closing mechanism; and, first and second hinges extending from first and second radially extending arms which in turn are attached to said base structure.

2. The tool-less entry landscape fixture of claim 1 further comprising first and second hinges extending from first and second radially extending arms which in turn are attached to said base structure.

3. The tool-less entry landscape fixture of claim 1 further comprising first and second hinge connection members depending from said fixture cover hingeably connected to said first and second hinges.

4. The tool-less entry landscape fixture of claim 3 wherein said first and second hinges are connected to said first and second hinge connection members by first and second pins.

5. The tool-less entry landscape fixture of claim 1 further comprising a third radially extending arm and having a ledge extending therefrom.

6. The tool-less entry landscape fixture of claim 1 wherein said base structure, said plurality of arms, and said fixture cover are made of die cast aluminum.

7. The tool-less entry landscape fixture of claim 1 wherein said lower portion has a threaded region.

8. The tool-less entry landscape fixture of claim 1 wherein said closing mechanism is a flexible hand operable latch.

9. The tool-less entry landscape fixture of claim 1 wherein said fixture cover is substantially bowl shaped.

10. The tool-less entry landscape fixture of claim 1 wherein said fixture cover has a reflective coating on an inner side.

11. The tool-less entry landscape fixture of claim 1 wherein said upper portion has a shelf therein.

12. The tool-less entry landscape fixture of claim 1 wherein said lower portion of said base structure is substantially cylindrical in shape.

13. The tool-less entry landscape fixture of claim 12 where said substantially cylindrically shaped lower portion is hollow.

14. The tool-less entry landscape fixture of claim 1 where said upper portion of said base structure is substantially conical in shape.

15. The tool-less entry landscape fixture of claim 1 where said fixture is substantially mushroom shaped.

16. The tool-less entry landscape fixture of claim 1 further comprising an optical lens.

17. The tool-less entry landscape fixture of claim 16 where said optical lens is cylindrical in shape and hollow.

18. The tool-less entry landscape fixture of claim 16 further comprising a sealing gasket between said optical lens and said upper portion of said base structure.

19. The tool-less entry landscape fixture of claim 16 further comprising a sealing gasket between said optical lens and said fixture cover.

20. The tool-less entry landscape fixture of claim 18 wherein said sealing gasket is a silicone gasket.

21. The tool-less entry landscape fixture of claim 1 further comprising a light source housed beneath said fixture cover.

22. The tool-less entry landscape fixture of claim 21 wherein said light source is a halogen bulb.

23. The fixture of claim 2 wherein said base portion is further comprised of an annular seat, said annular seat receiving said lens, said lens having a sealing material formed along an upper periphery and a lower periphery, said sealing material along said lower periphery resting within said annular seat of said base portion.

24. The fixture of claim 23 wherein said cover section is further comprised of a horizontally flat section, said horizontally flat section of said cover compressible against sealing material on said upper periphery of said lens.

* * * * *

UNITED STATES PATENT AND TRADEMARK OFFICE

CERTIFICATE OF CORRECTION

PATENT NO. : 6,523,982 B1
DATED : February 25, 2003
INVENTOR(S) : Eric O.M. Haddad It is certified that error appears in the above-identified patent and that said Letters Patent is hereby corrected as shown below:

Column 5,
Line 41, delete claim 2 as follows:
"The tool-less entry landscape fixture of claim 1 further comprising first and second hinges extending from first and second radially extending arms which in turn are attached to said base structure.";
Line 41, add:
-- 2. A landscape fixture, comprising:

a base portion;
a cover section hingeably affixed to said base portion;
a deformable retaining mechanism deformable about a retaining abutment;
a lamp surrounded by a lens, said lens forming a seal between said base portion and said cover section. --.

Signed and Sealed this

Twentieth Day of April, 2004

JON W. DUDAS
*Acting Director of the United States Patent and Trademark Office*